US006547581B2

(12) United States Patent
Zweigle et al.

(10) Patent No.: US 6,547,581 B2
(45) Date of Patent: Apr. 15, 2003

(54) PROTECTIVE DEVICE FOR A MULTIPOINT CONNECTOR

(75) Inventors: Peter Zweigle, Ditzingen (DE); Markus Lux, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 34 days.

(21) Appl. No.: 09/815,970

(22) Filed: Mar. 22, 2001

(65) Prior Publication Data

US 2001/0041468 A1 Nov. 15, 2001

(30) Foreign Application Priority Data

Mar. 22, 2000 (DE) ..... 200 05 381 U

(51) Int. Cl.[7] ..... H01R 13/52; H01R 13/44
(52) U.S. Cl. ..... 439/271; 439/281; 439/136
(58) Field of Search ..... 439/528, 529, 439/521, 281, 271, 136

(56) References Cited

U.S. PATENT DOCUMENTS 5,443,389 A * 8/1995 Hughes ..... 439/35
6,132,230 A * 10/2000 Shinozaki et al. ..... 439/281
6,227,913 B1 * 5/2001 Davis et al. ..... 439/621

* cited by examiner

*Primary Examiner*—Lynn D. Feild
*Assistant Examiner*—Chandrika Prasad
(74) *Attorney, Agent, or Firm*—Kenyon & Kenyon

(57) ABSTRACT

A protective device for a multipoint connector, which contains at least one contact element in a base that is in the form of a housing, the contact element being accessible through an opening in the base, and being connectable to a plug connector; the protective device being made of a protective element, which can be transferred from a protective position preventing the coupling, into a mounting position rendering the coupling possible; and the protective device being designed in such a manner, that it can be manufactured very inexpensively, and is very easy to handle or remove. To this end, the protective element is made of a foil, which can be applied directly to the rim of the base opening, in a detachable manner.

5 Claims, 1 Drawing Sheet

PROTECTIVE DEVICE FOR A MULTIPOINT CONNECTOR

BACKGROUND INFORMATION

In general, protective devices for multipoint connectors are designed so as to cover the ends of the multipoint-connector contact elements which, for example, are inserted at a plug connector in response to mounting the multipoint connector.

In addition, multipoint connectors of the aforementioned type are used to insert these contact elements into openings on a printed circuit board. Such printed circuit boards are found, for example, in control units.

Protective devices of the aforementioned type are becoming more and more important, since the contact elements are being manufactured increasingly thinner, in order to be able to accommodate several contact elements inside a multipoint connector that has acceptable outer dimensions. This is especially true in view of the active component parts on a printed circuit board having an increasingly higher degree of integration, along with the resulting miniaturization, and the dimensions (sizing) of a control device containing the printed circuit board being a determining factor.

Contact elements having a small cross-sectional area are especially endangered by improper handling; in particular, they are subject to bending, and therefore urgently require a protective device. However, such protective devices make it more difficult to mount the multipoint connector on the printed circuit board, especially because protective devices, e.g. in the form of cover (lid) elements, must be removed from the multipoint connector, in an additional mounting step. The cover elements themselves are then either one-way (non-recyclable) parts, which are thrown away, lead to increased waste-disposal fees, and result in a larger infrastructure; or else the protective caps are recycled which, however, also requires a correspondingly cost-intensive infrastructure.

Furthermore, protective devices are known which are disposed inside the multipoint connector; in the protective position, the protective device being arranged in such manner, that the contact elements are completely covered by the protective device; and in a mounting position, the contact elements being freed in such manner, that the protective device, together with the plug connector inserted into the opening of the multipoint connector, is pressed onto the bottom of the multipoint connector, so that the contact elements can be appropriately coupled to the plug connector or the printed circuit board. However, this design of the protective device is only suitable for such multipoint connectors having an appropriate dimension, which allows such a protective device to be positioned inside the multipoint connector. In addition, such protective devices are expensive.

Therefore, an object of the present invention is to provide a protective device for multipoint connectors, which avoids the disadvantages of the related art, can be produced inexpensively, and can be removed easily from the multipoint connector.

SUMMARY OF THE INVENTION

In comparison with the related art, the protective device for a multipoint connector, according to the present invention, has the advantage that the previously mentioned shortcomings are prevented, and that the protective device can be removed from the multipoint connector by simply pulling it off.

In addition, the design of the protective device according to the present invention allows the possibility of subjecting control devices, which include the multipoint connector, to leak-rate tests, since the multipoint connector is covered in a completely sealed manner, and no liquid, moisture, or vapors can penetrate into the multipoint connector.

As a final test, an alternative embodiment also provides the option of piercing the protective device, using testing needles, in order to establish an electrical contact. The protective foil then continues to be used only as a protection against electric shock, or the pierced protective device can be replaced by a new protective device, or the protective device already having the pierced openings can be glued together again by an additional adhesive strip, so that it is clearly visible, e.g. by using a different color, that the control device or the multipoint connector has been properly checked.

There are many possibilities and ways for applying the protective device to the multipoint connector. Upon manufacturing the protective foil, one embodiment can involve already applying an adhesive agent, e.g. a cement, on one side of the protective foil, the cement being protected by a protective foil. The protective foil must be removed accordingly before applying the protective element.

An additional specific embodiment involves fusing the plastic foil to the rim of the multipoint connector. The fusing can be carried out using both heat and ultrasound.

DETAILED DESCRIPTION

Figure 1:
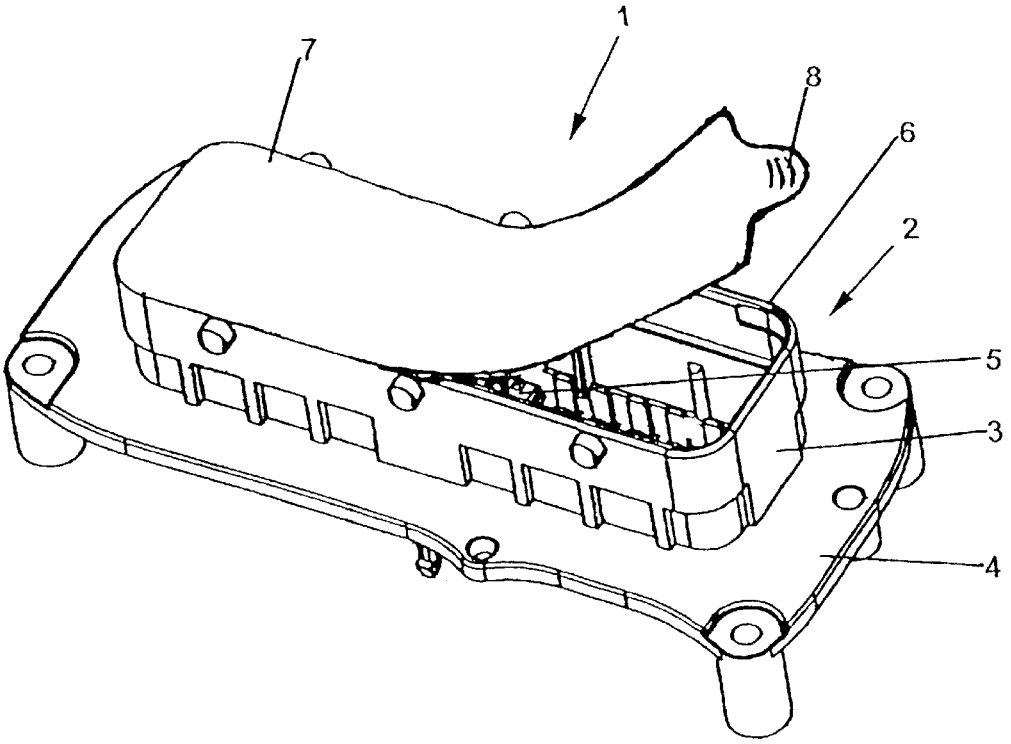
FIG. 1 shows a perspective view of a multipoint connector having the protective device, in a first exemplary embodiment having a partially removed protective device.

The exemplary embodiment represented in FIG. 1 is a protective device 1, which is at least partially pasted onto a multipoint connector 2. Multipoint connector 2 includes a base 3 and a printed circuit board 4 positioned underneath base 3. Base 3 itself is designed to receive a plug connector not shown in detail in the drawing, contact elements 5 disposed inside base 3 interacting with the corresponding contact elements of the plug connector. Base 3 has a box-shaped design, its side opposite to printed circuit board 4 having a rim 6 designed to be flat. First of all, this rim 6 is provided as a shoulder for the plug connector in its plugged-in state, the plug connector not being shown here in detail. In addition, the rim is provided for receiving protective device 1. Protective device 1 includes protective element 7, which has a foil-like design and an actuating element 8 on one side of protective element 7. In the closed state of protective device 1, actuating element 8 is designed to project over rim 6 of base 3, in order that protective element 7 can be gripped more easily for removing multipoint connector 2.

Protective element 7 is dimensioned in such a manner, that the remaining dimensions correspond to the cross-section of box-shaped base 3.

Figure 2:
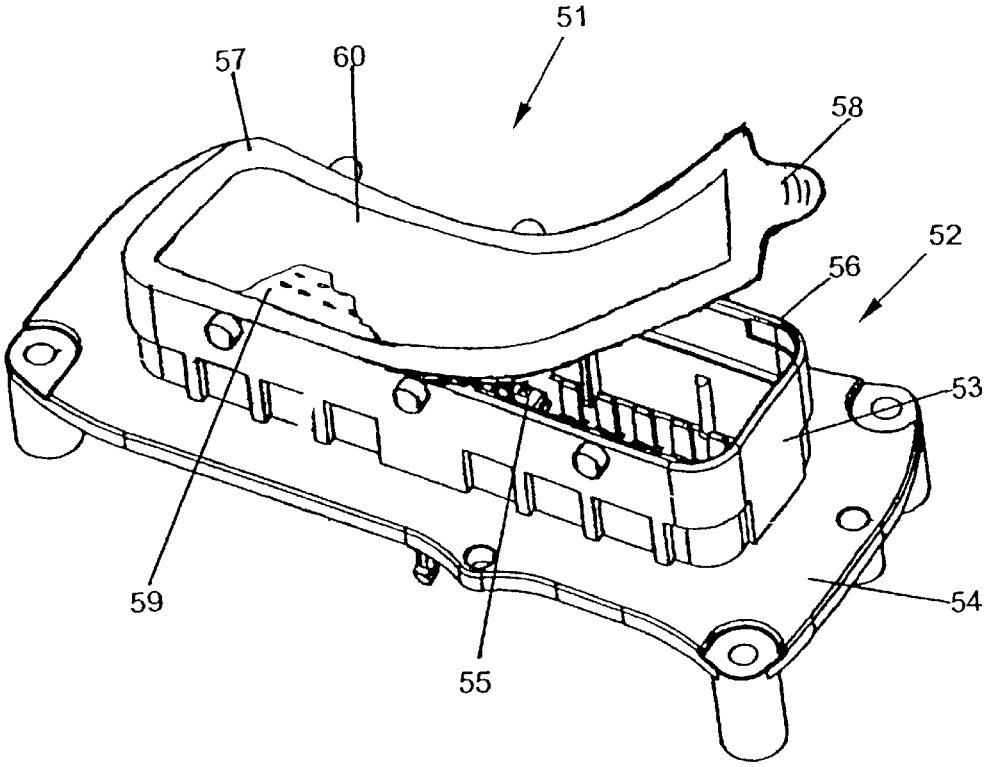
FIG. 2 shows a perspective view of a multipoint connector having the protective device, in a second exemplary embodiment having a partially removed protective device, as well.

Represented in the exemplary embodiment of FIG. 2 is a protective device 51, which is at least partially glued onto a multipoint connector 52. Multipoint connector 52 includes a base 53 and a printed circuit board 54 positioned underneath base 53. Base 53 itself is designed to receive a plug connector not shown in detail in the drawing, contact elements 55 disposed inside base 53 interacting with the corresponding contact elements of the plug connector. Base 53 has a box-shaped design, its side facing away from printed circuit board 54 having an edge 56 designed to be flat. First of all, this rim 56 is provided as a shoulder for the plug connector in its plugged-in state, the plug connector not being shown here in detail. In addition, the rim is provided for receiving protective device 51. Protective device 51 includes protective element 57, which has a foil-like design and an actuating element 58 on one side of protective element 57. In the closed state of protective device 51, actuating element 58 is designed to project over rim 56 of multipoint-connector 52 base 53, in order that protective element 57 can be gripped more easily for removing multipoint connector 52.

Protective element 57 is dimensioned in such a manner, that the remaining dimensions correspond to the cross-section of box-shaped base 53.

The second exemplary embodiment differs from the first exemplary embodiment, in that protective element 57 already has a plurality of openings 59 provided in protective element 57, which are aligned with contact elements 55 in the mounted position of protective device 51. This allows test prods to be used to establish an electrical contact between individual contact elements 55 and the test prod, without having to remove protective element 57.

If the test regarding the functionality of multipoint connector 52 has been conducted, then an additional adhesive strip 60, whose dimensions are smaller than those of protective element 57, is pasted over openings 59, so that, first of all, multipoint connector 52 is tightly sealed, and secondly, it can be clearly indicated that a test has already been conducted successfully or unsuccessfully for this multipoint connector 52(i.e., this multipoint connector 52 has already passed or failed a test).

Because of the simple design of protective device 1, 51, it is possible to easily protect multipoint connectors 52, whose bases 53 have very different dimensions.

What is claimed is:

1. A protective device for a multipoint connector, the multipoint connector including a base in the form of a housing and at least one contact element situated in the base, the base having an opening, the opening having a rim, the contact element being accessible via the opening in the base and being connectable to a plug connector, the protective device comprising:

a protective element movable from a protective position, preventing the connection of the contact element and the plug connector, to a mounting position, allowing the connection of the contact element and the plug connector, the protective element being composed of a foil, the protective element being applied directly to the rim of the opening in the base, in a detachable manner.

2. The protective device according to claim 1, wherein the protective element is a plastic foil.

3. The protective device according to claim 1, wherein the protective element includes an actuating tongue which, in the protective position of the protective element, extends over the rim.

4. The protective device according to claim 1, wherein the protective element has prefabricated openings which, in the mounting position of the protective element, align with contact elements of the multipoint connector.

5. The protective device according to claim 1, further comprising an adhesive agent applied on a side of the protective element facing the opening in the base.

* * * * *